US006203283B1

(12) United States Patent
Fleming et al.

(10) Patent No.: US 6,203,283 B1
(45) Date of Patent: Mar. 20, 2001

(54) SINGLE PIECE YOKE STROKING DEVICE FOR BENT AXIS TYPE HYDRAULIC PUMPS AND VARIABLE MOTORS

(75) Inventors: John P. Fleming, Ankeny; Scott D. Meyer; Dave D. Dirks, both of Ames, all of IA (US)

(73) Assignee: Sauer Inc., Ames, IA (US)

( * ) Notice: Subject to any disclaimer, the term of this patent is extended or adjusted under 35 U.S.C. 154(b) by 0 days.

(21) Appl. No.: 09/394,604

(22) Filed: Sep. 13, 1999

Related U.S. Application Data

(60) Provisional application No. 60/121,862, filed on Feb. 26, 1999.

(51) Int. Cl.[7] ..... F04B 1/26; F04B 49/00; F01B 3/00

(52) U.S. Cl. ..... 417/222.1; 417/218; 91/504

(58) Field of Search ..... 417/222.1, 218, 417/269; 91/506, 504

(56) References Cited

U.S. PATENT DOCUMENTS

| | | | |
|---|---|---|---|
| 2,931,250 | 4/1960 | Ebert | 477/69 |
| 3,142,963 | 8/1964 | Thoma | 60/492 |
| 3,148,628 | 9/1964 | Boydell | 91/506 |
| 3,958,496 | 5/1976 | Wallin | 91/506 |
| 4,129,063 * | 12/1978 | Ifield | 91/506 |
| 4,893,549 | 1/1990 | Forster | 92/12.2 |
| 4,945,817 * | 8/1990 | Scholl | 417/222.1 |
| 5,073,091 * | 12/1991 | Burgess et al. | 417/222.1 |
| 5,231,912 * | 8/1993 | Akasaka et al. | 91/499 |

OTHER PUBLICATIONS

"Data Sheet for Variable Pump/Motor V20," Volvo Hydraulics, pp. 1–4, published prior to 1980.

"Hydrostatics for power split transmissions," E. Skirde & M. Gigling, Industrial Vehicle Technology '98, pp. 30–33, published Dec. 1998.

* cited by examiner

*Primary Examiner*—Timothy S. Thorpe
*Assistant Examiner*—Michael K. Gray
(74) *Attorney, Agent, or Firm*—Zarley, McKee, Thomte, Voorhees & Sease

(57) ABSTRACT

A device for varying the displacement of a variable displacement bent axis unit includes a one-piece yoke having a bucket portion adapted to carry a cylinder block kit of the bent axis unit, a trunnion bearing portion for swing control on one side of the bucket portion, and a trunnion portion for fluid porting on the other side of the bucket portion. The bucket portion has a bottom wall, a continuous side wall, and an open top. Inside the yoke is a pair of fluid passages intersecting the interior of the bucket portion and extending separately and entirely within the bottom wall and the side wall before opening onto the trunnion portion for fluid porting.

18 Claims, 6 Drawing Sheets

SINGLE PIECE YOKE STROKING DEVICE FOR BENT AXIS TYPE HYDRAULIC PUMPS AND VARIABLE MOTORS

CROSS-REFERENCE TO RELATED APPLICATIONS

This application claims the benefit of U.S. Provisional Application Ser. No. 60/121,862 filed Feb. 26, 1999.

BACKGROUND OF THE INVENTION

The present invention relates to the field of variable displacement bent axis hydraulic units. More particularly, this invention relates to a swingable yoke for a bent axis unit.

Bent axis hydraulic units have been known for many years. However, one of the most persistent challenges facing bent axis designers is the provision of a cost-effective and reliable yoke for carrying the cylinder block kit and varying the displacement of the bent axis unit.

One known transmission utilizes a two-piece yoke design. This design combines an upper trunnion piece with a separate bolt-on endcap. This design relies on dowel pins to locate the endcap to the upper body. Seals are required for high-pressure transition passages and joints between the two parts. Furthermore, several bolts are required to hold the two parts together. The endcap must usually be made utilizing a slow and costly lapping process.

Therefore, a primary objective of the present invention is the provision of a one-piece yoke for a swinging bent axis hydraulic unit.

Another objective of this invention is the provision of a yoke that has a surface for supporting a cylinder block kit in the bottom of its bucket portion.

Another objective of the present invention is the provision of a yoke that has a pair of integrally formed fluid passages connecting the supporting surface to the control trunnion without leaving the wall of the yoke.

Another objective of the present invention is the provision of a yoke which has all of the system pressure and gauge ports located on a single trunnion.

Another objective of the present invention is the provision of an integral shoulder on the yoke for stopping its pivotal movement.

Another objective of the present invention is the provision of a yoke which is economical to manufacture, minimizes the number of parts required, and is reliable in use.

These and other objectives will be apparent from the drawings, as well as from the description and claims which follow.

SUMMARY OF THE INVENTION

This invention relates to a swinging yoke for a bent axis hydraulic unit. More particularly, the invention is a single piece yoke having a variety of other integral features.

Normally a multi-piece yoke assembly is used to vary the displacement in a variable displacement bent axis unit. However, the present invention utilizes a one-piece yoke having a bucket portion adapted to carry the cylinder block kit of the bent axis unit. A trunnion bearing portion for swing control resides on one side of the bucket portion, and a trunnion for fluid porting resides on the other side of the bucket portion.

The bucket portion includes a bottom wall, a continuous side wall, and an open top. The inside of the bucket is generally cylindrical, and the bottom wall of the inside of the bucket portion has an area thereon sufficiently large and strong enough to support the cylinder block kit when the unit is fully pressurized.

The yoke further includes a pair of fluid passages intersecting the support surface and extending separately and entirely within the bottom wall, the side wall and the trunnion for fluid porting. The fluid passages normally carry system pressure. Gauge ports are provided near the top of the yoke, and high pressure system ports are provided in the trunnion for fluid porting.

DETAILED DESCRIPTION OF THE PREFERRED EMBODIMENT

Figure 1:
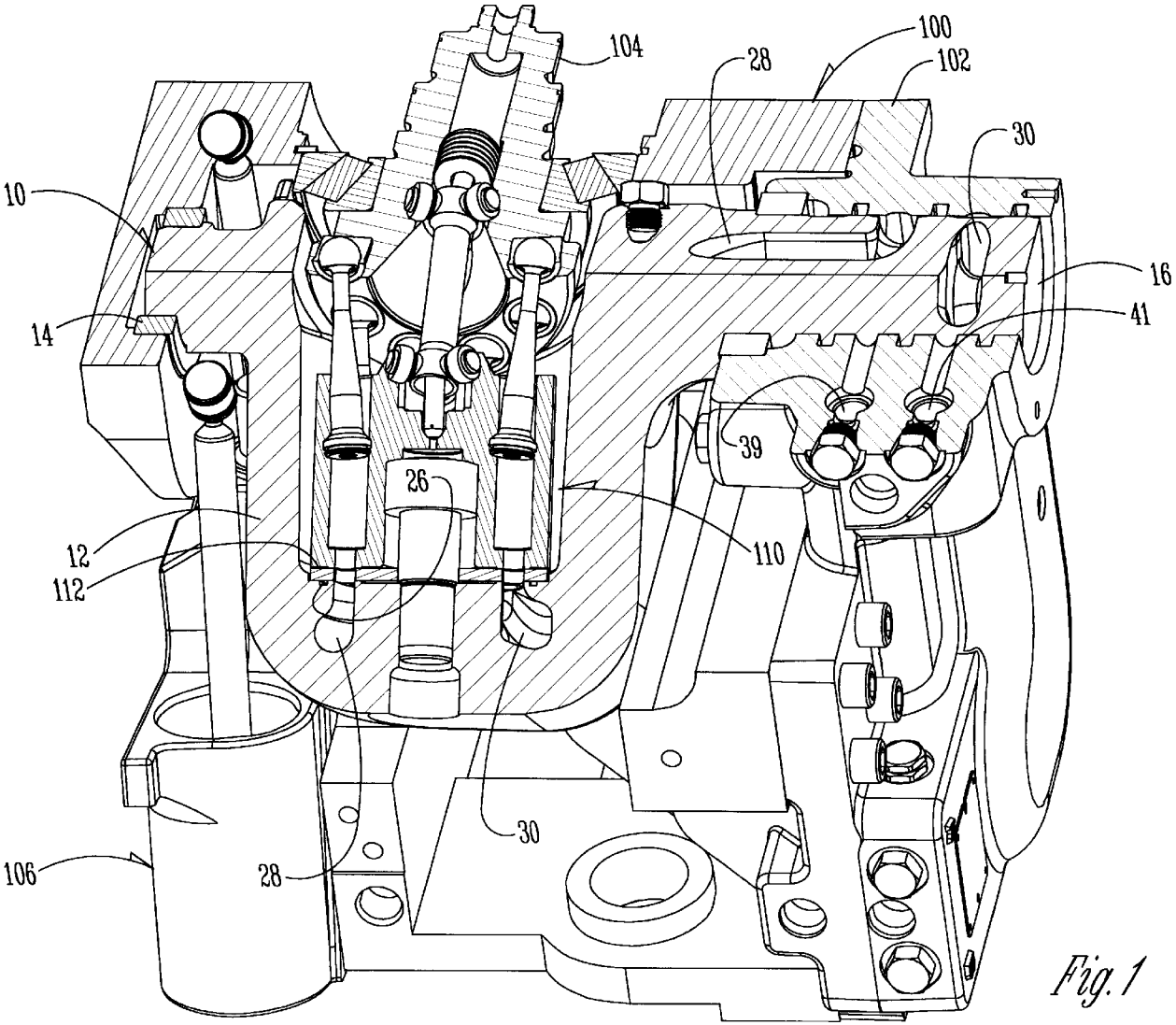
FIG. 1 is a perspective assembly view of a bent axis unit equipped with the yoke of this invention. Portions of the unit have been cut away to expose the yoke.

In the figures, the one-piece yoke of this invention is generally designated by the reference numeral 10. The yoke 10 is pivotally installed in the housing 102 of a bent axis unit 100 having a main shaft 104, as shown in FIG. 1. A rotatable cylinder block kit 110 is drivingly connected to the main shaft 104 of the unit 100. As is known in the art, the displacement of the cylinder block kit 110 varies (and thereby the fluid displacement of the unit 100 varies) as the yoke 10 is pivoted by servo means 106 with respect to the housing 102 and the main shaft 104.

The yoke 10 has a central bucket portion 12 adapted to swingably carry the cylinder block kit 110 of the bent axis unit 100. The yoke also includes a trunnion bearing portion or arm 14 for swing control on one side of the bucket portion 12 and a trunnion or arm for fluid porting 16 on the other side of the bucket portion 12.

Figure 2:
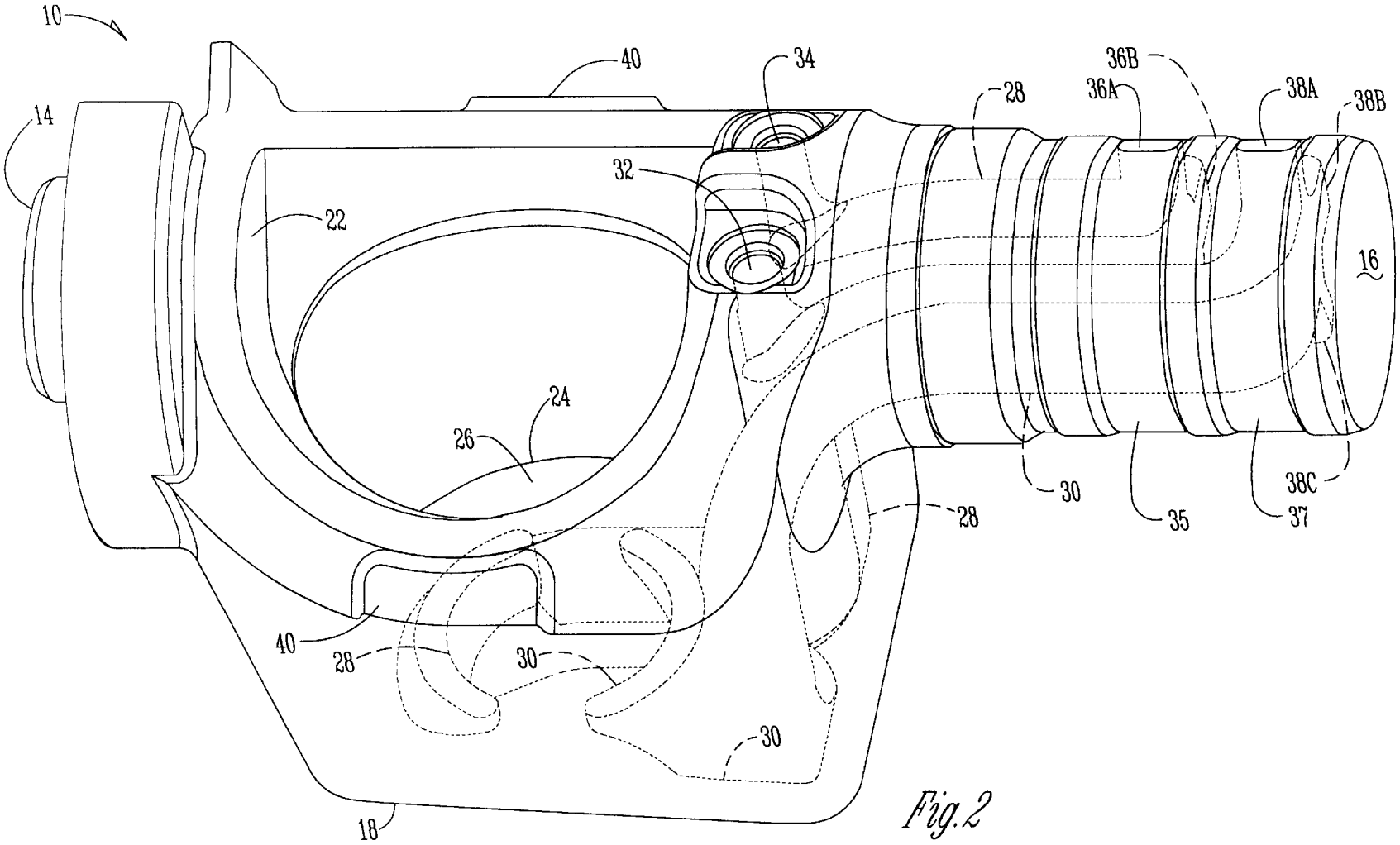
FIG. 2 is a perspective view of the yoke of this invention.
Figure 3:
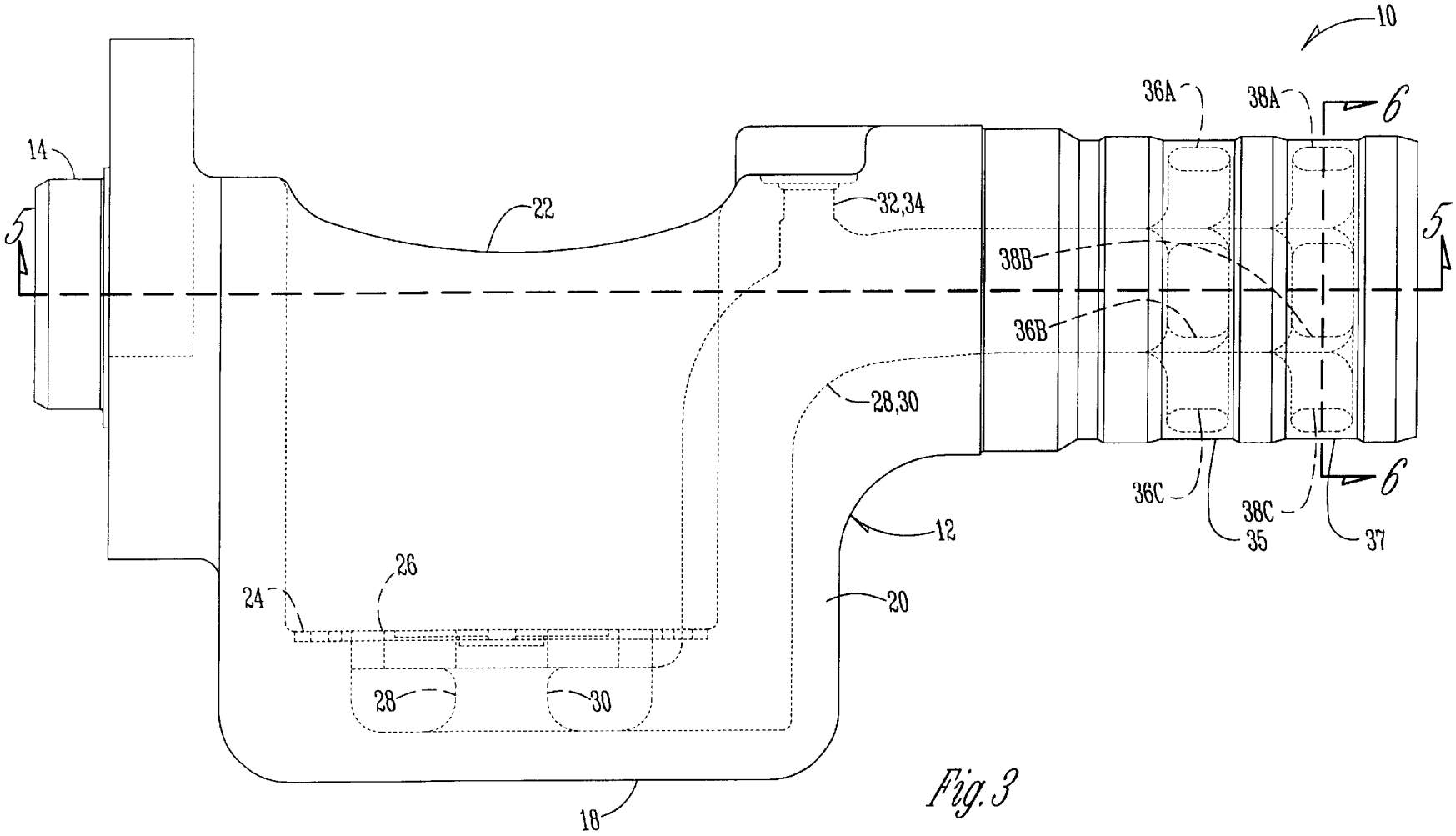
FIG. 3 is a front elevation view of the yoke of FIG. 2.

As best seen in FIGS. 1–3, the bucket portion 12 of the yoke 10 has a bottom wall 18, a continuous side wall 20, and an open top 22. The inside of the bucket portion 12 is generally cylindrical, and the bottom wall 18 on the inside of the bucket portion 12 has an area 24 thereon which is sufficiently large and strong enough to support the cylinder block kit 110 when the unit 100 is fully pressurized.

The yoke 10 is preferably formed of ductile iron and is at any rate cast in one piece. The bottom wall 18 on the inside of the bucket portion 12 is machined with an end mill to provide a flatness of approximately 0.005 mm/25.4 mm and an overall flatness of 0.0125 mm. This has been found to provide an effective surface 26 to support a valve plate 112 on which the cylinder block kit 110 can rotate.

Figure 4:
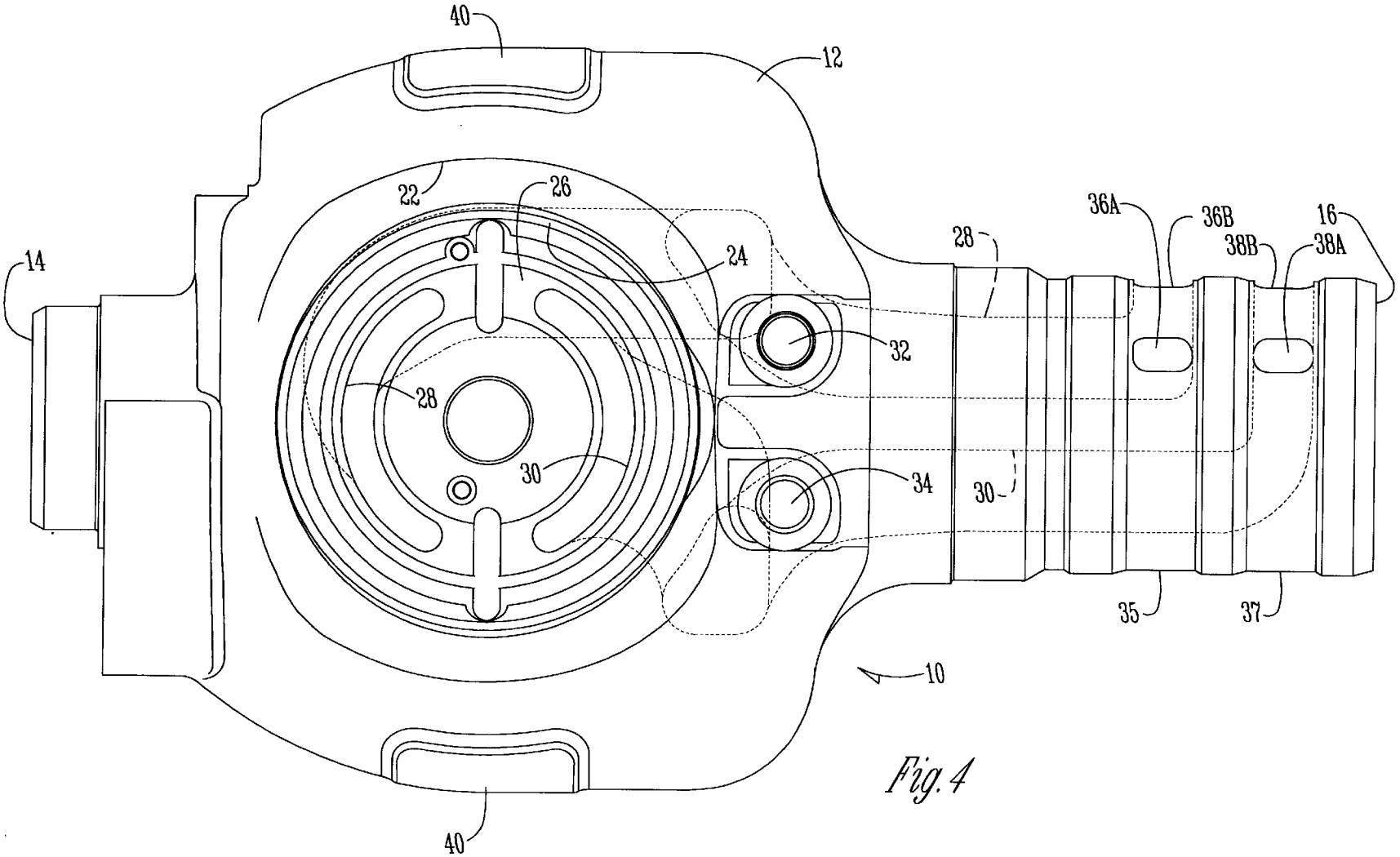
FIG. 4 is a top plan view of the yoke of FIG. 2.

FIGS. 2–4 show that a pair of fluid passages 28, 30 intersect the running surface 26 in the area 24. The passages 28, 30 extend separately and are entirely within the bottom wall 18, the side wall 20, and the trunnion for fluid porting 16. One of the fluid passages 28, 30 normally carries high-pressure fluid (in the range of 3,000 to 7,000 psi) when the cylinder block kit 110 rotates in one direction. Meanwhile, the other of the fluid passages 28, 30 normally carries relatively low pressure fluid, such as control or charge pressure of about 50 to 500 psi. Of course, the normal pressures of the bent axis unit 100 may vary, depending upon the system requirements. The invention is applicable to other system pressure requirements with only minor modifications.

Figure 5:
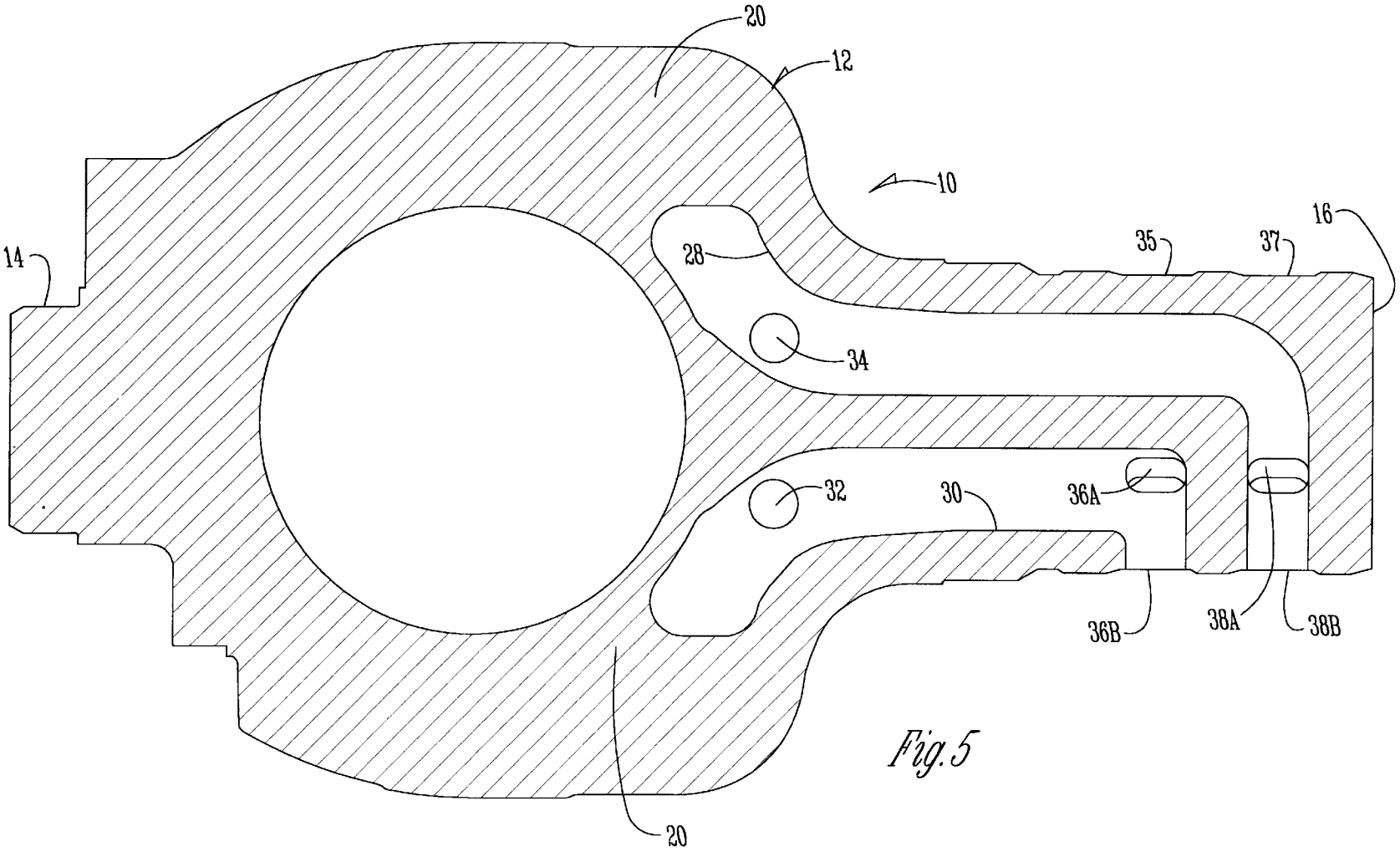
FIG. 5 is a sectional view of the yoke taken along line 5—5 in FIG. 3.

The passages 28, 30 extend across the bottom wall 18 of the yoke 10. Then the passages 28, 30 extend upwardly within the side wall 20. Near the top of the yoke 10, gauge ports 32, 34 can be provided. The gauge ports 32, 34 extend into the yoke 10 adjacent the open top 22 so that they intersect the fluid passages 28, 30 respectively. See FIG. 5, too. The fluid passages 28, 30 curve and extend into the trunnion for fluid porting 16.

Figure 6:
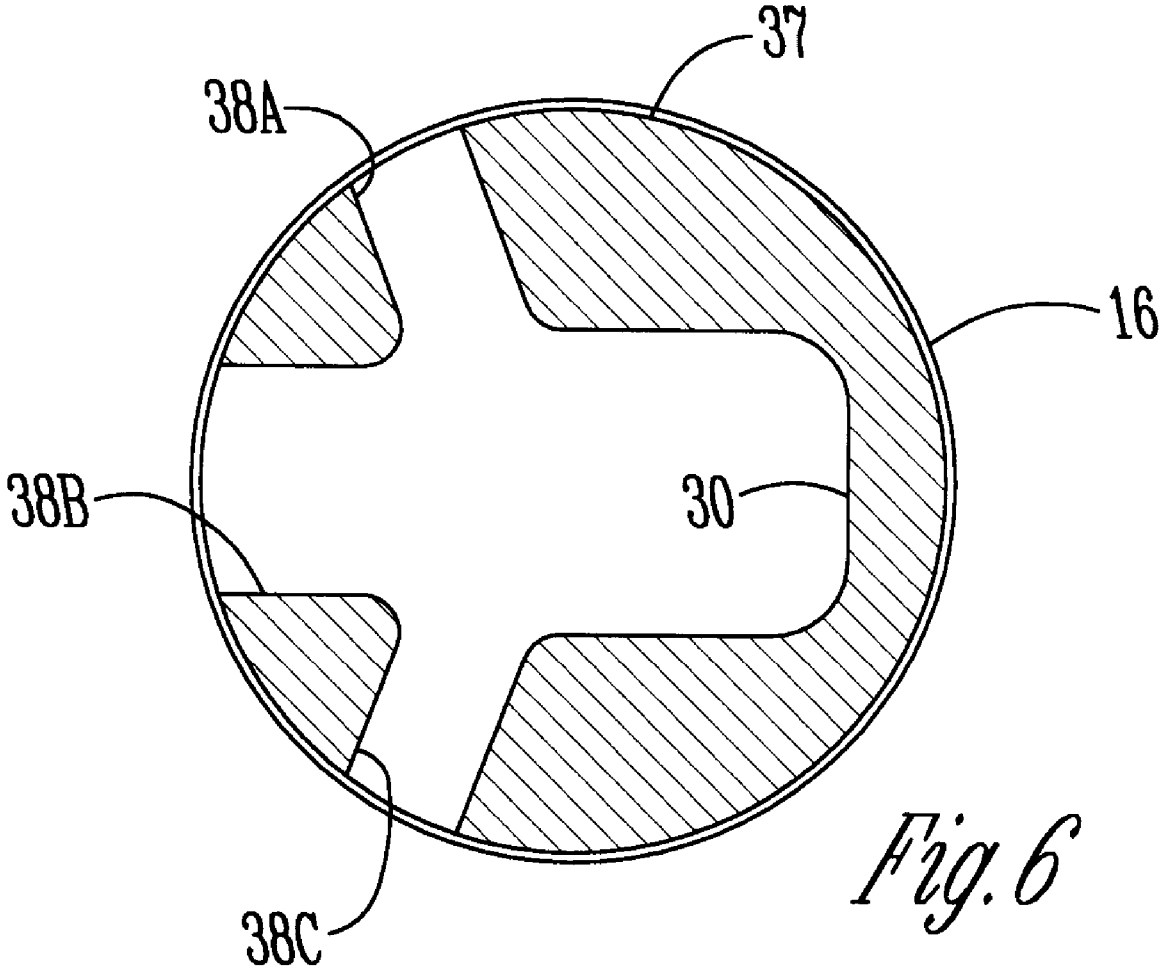
FIG. 6 is a sectional view of the fluid porting trunnion of the yoke taken along line 6—6 in FIG. 3.

As best seen in FIG. 6, high-pressure system ports 36A, 36B, 36C; 38A, 38B, 38C are axially spaced apart on the trunnion 16 and intersect the fluid passages 28, 30 respectively. Only ports 38A, 38B, 38C are shown in FIG. 6, but the configuration is typical of ports 36A, 36B, 36C as well. Referring again to FIGS. 1, 3 and 4, annular grooves 35, 37 put the system pressure ports 36A, 36B, 36C; and 38A, 38B, 38C in fluid communication with the system pressure ports 39, 41 respectively in the housing 102. As is apparent from FIG. 1, appropriate seals (not shown) and intervening shoulders can be provided on the trunnion 16 or the surrounding parts to ensure that the ports 36A, 36B, 36C; 38A, 38B, 38C are isolated from each other.

The fluid passages 28, 30 can be cored directly into the yoke 10 when the yoke 10 is cast. The yoke 10 is formed as a strong and integral one-piece unit, which eliminates many of the existing machining and assembly concerns about the bent axis unit 100.

Another feature of the yoke 10 of this invention is that it has at least one shoulder 40 on the yoke 10 for stopping the pivotal movement of the yoke 10 by abutment against an adjacent frame member (not shown). The location and extent of the shoulder 40 can be varied to meet the particular design requirements. The shoulder 40 can be machined or cast in place. The shoulder 40 provides a hard or positive stop for limiting the swinging of the yoke 10.

The yoke of this invention can be applied to a bent axis variable displacement hydraulic pump or a bent axis variable displacement hydraulic motor. In the case of a pump, rotational energy is converted into high pressure fluid or hydraulic energy. In the case of a motor, the hydraulic or high pressure fluid energy is converted into rotation energy. The essential features of the yoke remain the same.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention.

What is claimed is:

1. A device for varying displacement of a variable displacement bent axis unit comprising:

a housing and a rotatable cylinder block kit disposed inside the housing;

a one-piece swingable yoke pivotally mounted in the housing and carrying the cylinder block kit;

the yoke comprising a bucket portion for supporting the cylinder block kit and a pair of generally opposing arms extending from the bucket portion one of the arms defining a trunnion bearing portion for swing control, and the other of the arms defining a trunnion portion for fluid porting on the opposing arm, together the trunnion bearing portion and the trunnion portion for fluid porting defining a pivot axis for swinging the yoke;

the bucket portion of the yoke including a bottom wall, at least one continuous side wall extending upwardly from the bottom wall, and an open top defining a hollow in the bucket portion; and the hollow and the trunnion portion for porting being fluidly connected by a pair of spaced apart fluid passages extending continuously completely within the bottom wall and the side wall to the trunnion portion for porting.

2. The device of claim 1 wherein the pair of spaced apart fluid passages normally carry fluid at a system pressure when the cylinder block kit rotates.

3. The device of claim 1 wherein the yoke has at least one shoulder formed thereon for stopping pivotal movement of the yoke.

4. The device of claim 3 wherein the shoulder is provided on the side wall adjacent the open top.

5. The device of claim 1 wherein a first system pressure port extends into the trunnion portion for fluid porting so as to intersect one of the pair of spaced apart fluid passages and a second system pressure port extends into the trunnion portion for fluid porting so as to intersect the other of the pair of spaced apart fluid passages.

6. The device of claim 1 wherein a first system pressure gage port extends into the side wall of the yoke adjacent the open top so as to intersect one of the pair of spaced apart fluid passages and a second system pressure gauge port extends into the side wall of the yoke adjacent the open top so as to intersect the other of the pair of spaced apart fluid passages.

7. The device of claim 1 wherein the hollow in the bucket portion is generally cylindrical.

8. The device of claim 1 wherein the trunnion portion for fluid porting is an elongated generally cylindrical handle member protruding from the bucket portion.

9. The device of claim 8 wherein the trunnion bearing portion has a truncated cylindrical bearing diameter portion for pivotally supporting the yoke in the housing, the trunnion bearing portion protruding from the bucket portion less than the handle member of the trunnion portion for fluid porting.

10. The device of claim 8 wherein the trunnion portion for fluid porting includes a cylindrical bearing diameter portion thereon for pivotally supporting the yoke in the housing.

11. The device of claim 1 wherein the yoke is formed as a single piece continuous integral casting with the pair of spaced apart fluid passages cored into the casting.

12. A device for varying fluid displacement in a variable displacement bent axis unit comprising:

a swingable yoke including a bucket portion and being pivotally supported along a pivot axis defined by first and second trunnions portions extending from the bucket portion in generally opposite directions;

the bucket portion having first and second spaced apart system ports therein;

one of the first and second trunnion portions having third and fourth spaced apart system ports thereon;

a pair of continuous unbroken fluid passages respectively interconnecting the first port with the third port and the second port with the fourth port without extending outside of the bucket portion.

13. The device of claim 12 wherein the third and fourth system ports are on the first trunnion portion and the second trunnion portion is free of any system ports.

14. A device for varying fluid displacement in a variable displacement bent axis unit comprising:

a pivotal yoke including a bucket portion and integral first and second trunnion portions extending in generally opposite directions from the bucket portion so as to together define a pivot axis for swinging the yoke and thereby varying the fluid displacement of the unit;

the bucket portion including a pair of spaced apart system pressure ports therein and a pair of spaced apart system pressure fluid passageways beginning at said pair of ports respectively and extending separately and completely within the bucket portion to the first trunnion portion, both of the passageways opening onto the first trunnion portion.

15. The device of claim 14 wherein the second trunnion bearing portion is free of fluid passages extending therethrough for porting hydraulic fluid at a system pressure into the bucket portion.

16. A bent axis hydraulic unit comprising:

a housing;

a main shaft rotatably supported in the housing;

a pair of system pressure ports in the housing;

a swingable one-piece yoke pivotally mounted in the housing, the yoke including a bucket portion and an elongated pivot arm extending from the bucket portion to define a pivot axis for the bucket portion of the yoke;

the bucket portion of the yoke including a bottom wall and at least one side wall integrally formed with the bottom wall and extending upwardly therefrom to define an interior of the bucket portion;

the pivot arm having a pair of separate system pressure passageways in fluid communication respectively with the system pressure ports in the housing, the pair of passageways extending into the elongated pivot arm and then extending entirely within the elongated pivot arm into the at least one side wall of the bucket portion and then extending downwardly entirely within the at least one side wall and into the bottom wall, the passageways then extending entirely within the bottom wall until opening into a pair of separate ports disposed in the interior of the bucket portion and located on an upper surface of the bottom wall;

a cylinder block kit swingably carried by the yoke, the cylinder block kit being rotatably mounted in the interior of the bucket portion and supported by the bottom wall of the bucket portion, the cylinder block kit being in fluid communication with the system pressure ports in the housing through the pair of system pressure passageways and the respective ports located on the bottom wall, the cylinder block kit being drivingly connected to the main shaft of the unit;

means for pivoting the yoke and thereby the cylinder block kit with respect to the housing and the main shaft.

17. The hydraulic unit of claim 16 comprising a second pivot arm extending from the bucket portion in a direction generally opposite the elongated pivot arm, the second pivot arm being shorter than the elongated pivot arm.

18. The hydraulic unit of claim 16 wherein the means for pivoting the yoke is a pair of operatively opposing servo means that engage the second pivot arm on opposite sides of the pivot axis.

* * * * *

UNITED STATES PATENT AND TRADEMARK OFFICE

CERTIFICATE OF CORRECTION

PATENT NO. : 6,203,283 B1
DATED : March 20, 2001
INVENTOR(S) : John P. Fleming; Scott D. Meyer; and Dave D. Dirks It is certified that error appears in the above-identified patent and that said Letters Patent is hereby corrected as shown below:

Column 4,
Lines 63, and 64, delete the following:
"without extending outside of the bucket portion".

Signed and Sealed this

Fifteenth Day of January, 2002

*Attest:*

*Attesting Officer*

JAMES E. ROGAN
*Director of the United States Patent and Trademark Office*